US010126684B2

(12) United States Patent
Mizutani

(10) Patent No.: US 10,126,684 B2
(45) Date of Patent: Nov. 13, 2018

(54) DEVELOPING DEVICE

(71) Applicant: Brother Kogyo Kabushiki Kaisha, Nagoya-shi, Aichi-ken (JP)

(72) Inventor: Hiromitsu Mizutani, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/638,851

(22) Filed: Jun. 30, 2017

(65) Prior Publication Data

US 2018/0011426 A1 Jan. 11, 2018

(30) Foreign Application Priority Data

Jul. 8, 2016 (JP) ..... 2016-135863

(51) Int. Cl.
*G03G 15/08* (2006.01)

(52) U.S. Cl.
CPC ..... *G03G 15/0898* (2013.01); *G03G 15/0808* (2013.01); *G03G 15/0817* (2013.01); *G03G 15/0841* (2013.01); *G03G 15/0882* (2013.01); *G03G 15/0832* (2013.01); *G03G 15/0865* (2013.01); *G03G 15/0889* (2013.01)

(58) Field of Classification Search
CPC ..... G03G 15/0808; G03G 15/0817; G03G 15/0832; G03G 15/0841; G03G 15/0843; G03G 15/0881; G03G 15/0882; G03G 15/0884; G03G 15/0898
See application file for complete search history.

(56) References Cited

U.S. PATENT DOCUMENTS 5,953,563 A * 9/1999 Yamaguchi ..... G03G 15/09 399/119

FOREIGN PATENT DOCUMENTS

| | | | |
|---|---|---|---|
| JP | H09-134104 A | | 5/1997 |
| JP | 11352777 A | * | 12/1999 |
| JP | 2000-029296 A | | 1/2000 |
| JP | 2000-122418 A | | 4/2000 |
| JP | 2015-187718 A | | 10/2015 |

OTHER PUBLICATIONS

Machine Translation of JP 11-352777 A. Dec. 24, 1999.*
Machine Translation of JP 2015-187718. Oct. 29, 2015.*

* cited by examiner

*Primary Examiner* — Carla Therrien
(74) *Attorney, Agent, or Firm* — Banner & Witcoff, Ltd.

(57) ABSTRACT

A developing device, including a casing and a seal member is provided. The casing includes a divider wall, dividing a space inside the casing into a container chamber and a developing chamber, and a developing roller. The divider wall includes an opening. The container chamber accommodates a developing agent. The seal member is configured to seal the opening. The seal member includes a ventilation section configured to allow air to pass there-through but restrict the developing agent from passing there-through at least at a part of an area that seals the opening.

21 Claims, 10 Drawing Sheets

DEVELOPING DEVICE

CROSS REFERENCE TO RELATED APPLICATION

This application claims priority from Japanese Patent Application No. 2016-135863, filed on Jul. 8, 2016, the entire subject matter of which is incorporated herein by reference.

BACKGROUND

Technical Field

An aspect of the present invention is related to a developing device having a container chamber to contain a developing agent and a developing chamber accommodating a developing roller.

Related Art

A developing device for developing an image in a developing agent is known. The developing device may include a container chamber, a developing chamber, a conveyer unit, and a sealer. The container chamber may contain the developing agent therein, and the conveyer unit may convey the developing agent from the container chamber to the developing chamber through an opening formed between the container chamber and the developing chamber. The developing chamber may accommodate a developing roller, which may carry the conveyed developing agent thereon. The sealer may seal the opening while the developing device is in an unused condition. The conveyer unit in the developing device may include a shaft, which may be hollow inside and have an inlet at an axial end area and an outlet at a lateral area thereof. The developing agent may be transferred from an agent loading device through the shaft to the container chamber and conveyed to the developing chamber. For example, the agent loading device may have a nozzle, which may be inserted in the inlet, so that the developing agent may enter and exit the shaft through the inlet and the outlet to be loaded in the container chamber.

SUMMARY

The opening formed between the container chamber and the developing chamber may be sealed by the sealer member to prevent leakage of the developing agent from the container chamber. Meanwhile, air inside the container chamber may tend to stay therein without substantially moving while the developing agent is being loaded in the container chamber. Therefore, the developing agent may be restrained from entering the container chamber, and a loading efficiency of the developing agent may be lowered.

The present disclosure is advantageous in that a developing device capable of restraining leakage of a developing agent through an opening and increasing a loading efficiency of the developing agent is provided.

According to an aspect of the present disclosure, a developing device, including a casing and a seal member is provided. The casing includes a divider wall and a developing roller. The divider wall divides a space inside the casing into a container chamber and a developing chamber. The divider wall includes an opening, and the container chamber accommodates a developing agent. The seal member is configured to seal the opening. The seal member includes a ventilation section configured to allow air to pass there-through but restrict the developing agent from passing there-through at least at a part of an area that seals the opening.

According to another aspect of the present disclosure, a developing device, including a casing and an agitator is provided. The casing includes a divider wall and a developing roller. The divider wall divides a space inside the casing into a container chamber and a developing chamber. The divider wall includes an opening. The container chamber accommodates a developing agent. The agitator is placed inside the container chamber and assembled to the casing. The agitator includes a shaft and a sealer sheet fixed to the shaft and attached around the opening in the divider wall. The sealer sheet includes a ventilation member. The ventilation member includes a plurality of ventilating holes. A size of each of the plurality of ventilating holes is between 4 and 8 μm at a diameter basis.

BRIEF DESCRIPTION OF THE ACCOMPANYING DRAWINGS

Figure 10A:
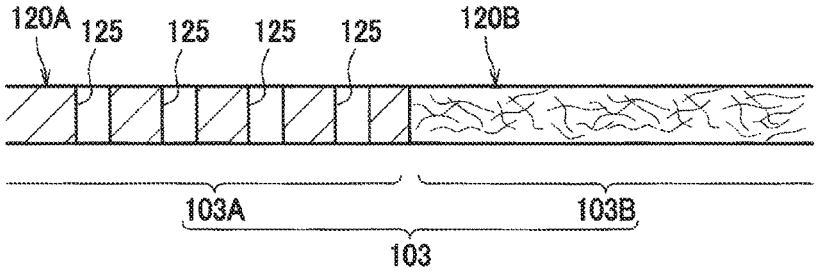
Figure 10B:
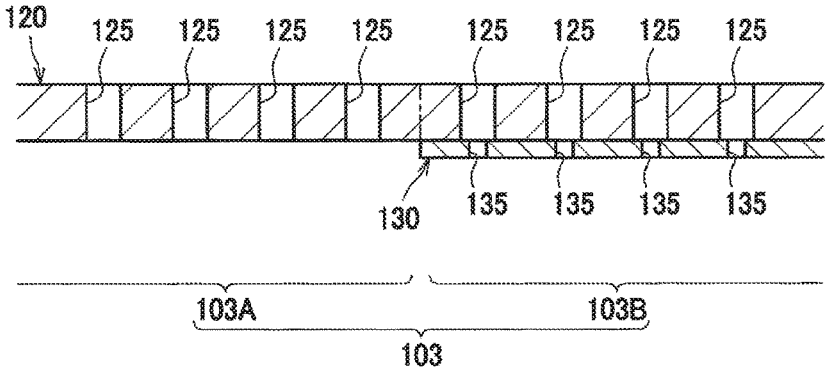

FIG. 10A is an enlarged cross-sectional view of the ventilation member with the first ventilation section and the second ventilation section in a fourth modified example of the second embodiment of the present disclosure. FIG. 10B is an enlarged cross-sectional view of the ventilation member with the first ventilation section and the second ventilation section in a fifth modified example of the second embodiment of the present disclosure.

Figure 1:
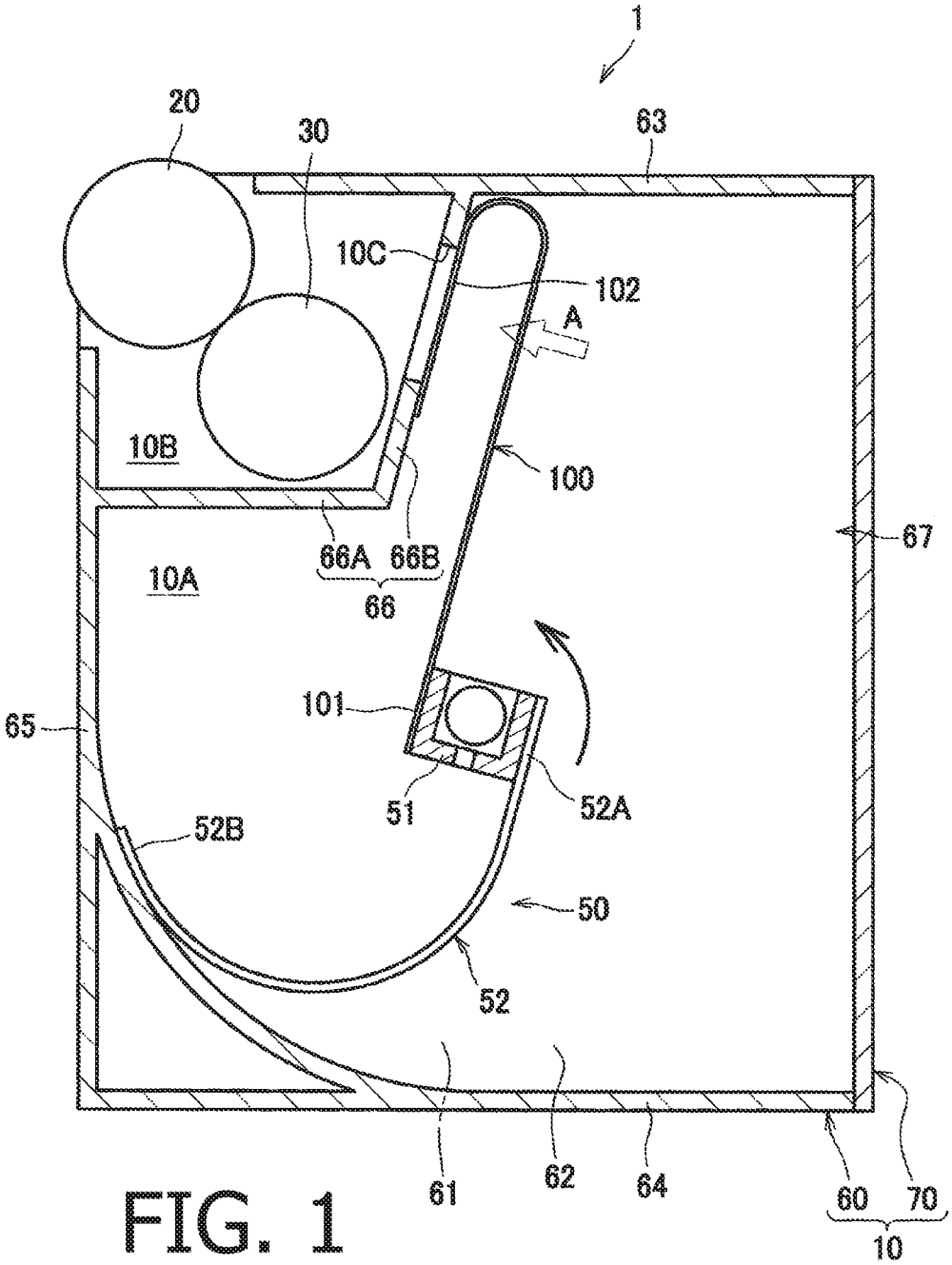
FIG. 1 illustrates a cross-sectional view of a developing device according to an embodiment of the present disclosure.
Figure 11A:
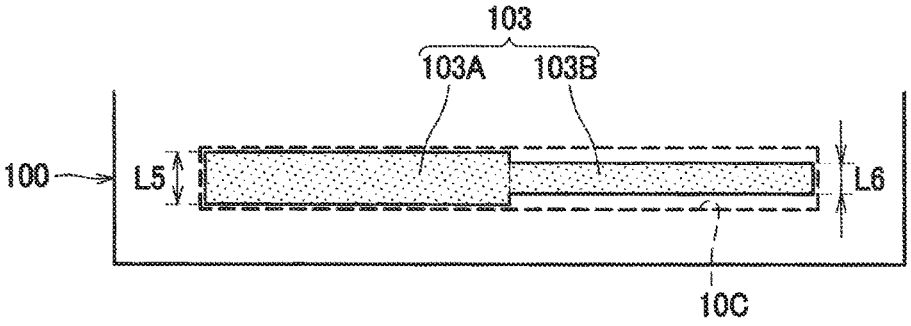
Figure 11B:
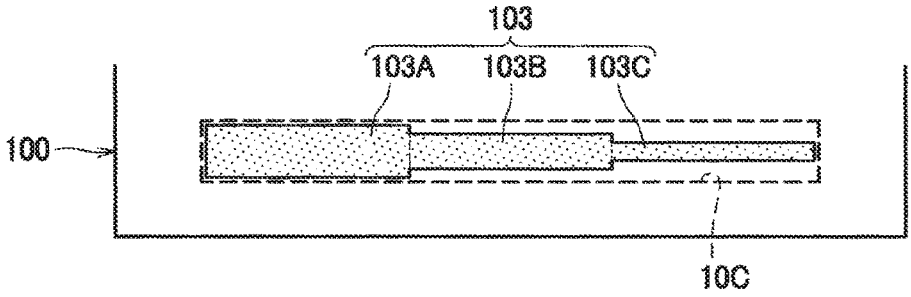
Figure 11C:
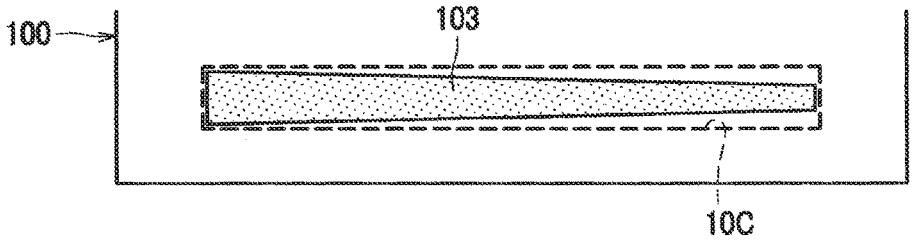

FIG. 11A is an illustrative view of the ventilation member with the first ventilation section and the second ventilation section in a sixth modified example of the second embodiment of the present disclosure viewed along the direction A shown in FIG. 1. FIGS. 11B-11C are illustrative views of the ventilation member in a third embodiment of the present disclosure viewed along the direction A shown in FIG. 1.

Figure 12:
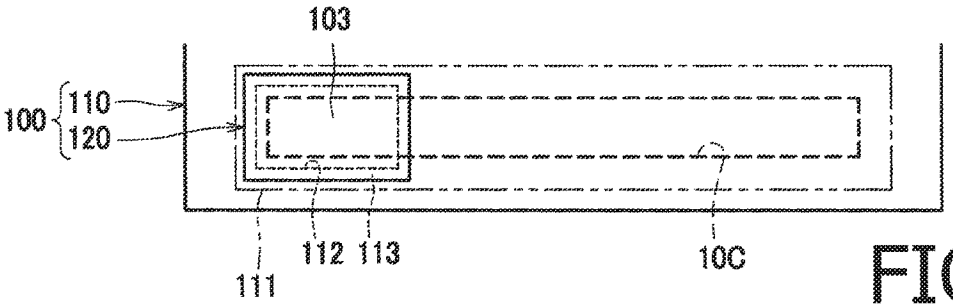

FIG. 12 is an illustrative view of the seal member in the developing device according to a fourth embodiment of the present disclosure viewed along the direction A shown in FIG. 1.

Figure 13:
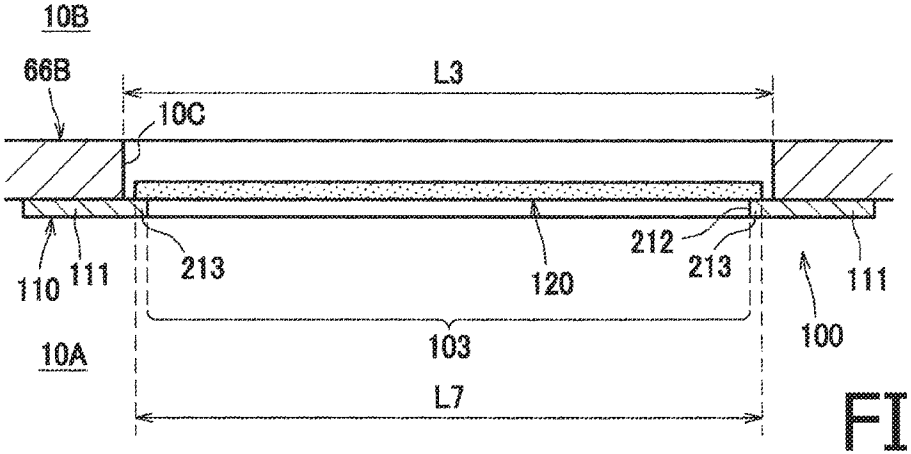

FIG. 13 is a cross-sectional view of the seal member and the divider wall in the developing device according to a fifth embodiment of the present disclosure.

DETAILED DESCRIPTION

Hereinafter, embodiments of the present disclosure will be described with reference to the accompanying drawings. A developing device 1 according to an embodiment of the present disclosure includes, as shown in FIG. 1, a casing 10, a developing roller 20, a supplying roller 30, and an agitator 50.

The developing roller 20 is rotatably supported by the casing 10 and may carry a toner being an example of a developing agent on a surface thereof. The supplying roller 30 is rotatably supported by the casing 10 and may supply the toner to the developing roller 20.

The agitator 50 may agitate the toner stored in the casing 10 and supply the agitated toner to the supplying roller 30. The agitator 50 includes a shaft 51 and an agitator sheet 52.

The shaft 51 extends longitudinally along a direction of rotation axes of the developing roller 20 and the supplying roller 30 and is rotatably supported by the casing 10. The shaft 51 is configured to be driven by a driving force from a driving source such as a motor (not shown) to rotate, for example, counterclockwise in FIG. 2. In the following description, a direction of an axis of the shaft 51 may be referred to as an "axial direction."

The agitator sheet 52 is a flexible sheet and may be, for example, made in resin and formed in a rectangular shape, which is longer in the axial direction. The agitator sheet 52 is arranged inside a container chamber 10A in the casing 10 and is supported at a base end portion 52A by the shaft 51. The agitator sheet 52 may be fixed to the shaft 51 at the base end portion 52A by, for example, an adhesive agent. The agitator sheet 52 in the casing 10 is in such an arrangement that a loose end portion 52B thereof should contact an inner surface of the container chamber 10A. The agitator sheet 52 rotates along with the counterclockwise rotation (FIG. 2) of the shaft 51 to stir the toner in the casing 10A and supply the toner from the container chamber 10A to a developing chamber 10B, which will be described later in detail.

The casing 10 includes the container chamber 10A, the developing chamber 10B, a body 60, and a cover 70. The container chamber 10A may contain the toner. The developing chamber 10B accommodates the developing roller 20 and the supplying roller 30 therein.

The body 60 includes a first side wall 61, a second side wall 62, a third side wall 63, a fourth side wall 64, a fifth side wall 65, and a divider wall 66. The first side wall 61 and the second side wall 62 are arranged to face each other along the axial direction. The third side wall 63 and the fourth side wall 64 are arranged to face each other along a direction orthogonal to the axial direction and connect ends of the first side wall 61 and the second side walls 62 with one another. The fifth side wall 65 connects ends of the first side wall 61, the second side wall, and the fourth side wall 64, which are on a side opposite to a side of the cover 70, with one another. The divider wall 66 divides a space inside the casing 10 into the container chamber 10A and the developing chamber 10B. The side of the body 60, on which the cover 70 is arranged, may open to form an assembling opening 67, through which inner parts such as the agitator 50 may be placed inside the container chamber 10A and assembled to the casing 10.

The container chamber 10A may be formed by the first, second, third, fourth, and fifth side walls 61-65, the divider wall 66, and the cover 70. The developing chamber 10B may be formed by the first, second, and third side walls 61-63, the fifth side wall 65, and the divider wall 66. The items that form the container chamber 10A and the developing chamber 10B may not necessarily be limited to those recited above respectively.

The divider wall 66 includes a first wall 66A and a second wall 66B. The first wall 66A extends from the fifth side wall 65, and the second wall 66B extends obliquely from an end of the first wall 66A to the third side wall 63. The second wall 66B includes an opening 10C, through which the container chamber 10A and the developing chamber 10B communicate each other.

Figure 3:
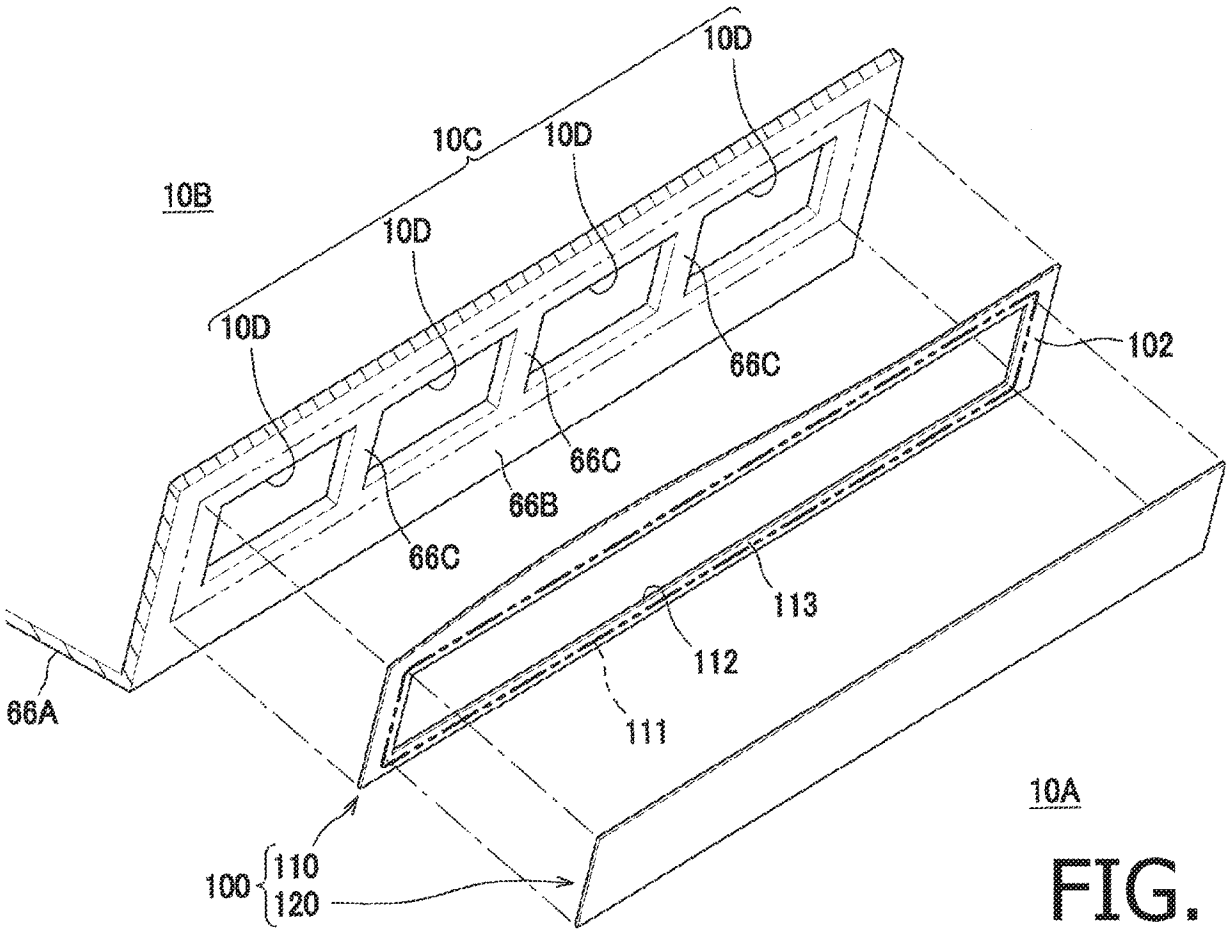
FIG. 3 illustrates a perspective view of a divider wall, a base member, and a ventilation member in the developing device according to the embodiment of the present disclosure.

The opening 10C provides a channel to transfer the toner from the container chamber 10A to the developing chamber 10B. The opening 10C includes, as shown in FIG. 3, a plurality of supplier openings 10D, which align along the axial direction. Between adjoining supplier openings 10D, 10D, formed is an enhancing portion 66C, which may enhance rigidity of the second wall 66B.

With regard to the opening 10C, which includes the plurality of supplier openings 10D, the direction along which the supplier openings 10D align may be referred to as a "lengthwise direction of the opening 10C." On the other hand, a direction orthogonal to the lengthwise direction may be referred to as a "widthwise direction of the opening 10C." The lengthwise direction of the opening 10C may coincide with the axial direction in the present embodiment. Meanwhile, the opening 10C may not necessarily include the plurality of supplier openings 10D but may be formed as a single opening extending longitudinally along the axial direction (see, for example, FIG. 12).

Referring back to FIG. 1, the cover 70 may form a part of walls in the container chamber 10A together with the body 60. The cover 70 is arranged to close the assembling opening 67 of the body 60. The cover 70 is fixed to the first, second, third, and fourth side walls 61-64 in the body 60 by, for example, welding or adhesion.

In the developing device 1 configured as above, the toner contained in the container chamber 10A may be stirred and conveyed by the agitator 50 toward the opening 10C and transferred to be supplied to the developing chamber 10B through the opening 10C. The toner transferred to the developing chamber 10B may be forwarded to the supplying roller 30 and supplied to the developing roller 20 from the supplying roller 30 to be carried on the surface of the developing roller 20. The toner carried on the surface of the developing roller 20 may be supplied to an electrostatic latent image, which is formed on a surface of a photosensitive member (not shown). Thus, the electrostatic latent image may be developed to be visualized to form a toner image on the surface of the photosensitive member.

Meanwhile, as shown in FIG. 1, the developing device 1 further includes a seal member 100. The seal member 100 is a flexible sheet and is arranged inside the container chamber 10A together with the agitator 50. In this embodiment, the seal member 100 may be made of a material, such as PET, PC or PPS, which has flexibility.

The seal member 100 may be fixed to the shaft 51 of the agitator 50 at a base end portion 101 by an adhesive agent to be supported by the shaft 51. The seal member 100 may rotate along with the counterclockwise rotation (FIG. 2) of the shaft 51 as well as the agitator sheet 52. The base end portion 101 is fixed to a face of the shaft 51 on a side opposite to a face, to which the base end portion 52A of the agitator sheet 52 is fixed, so that the shaft 51 is interposed between the base end portion 101 of the seal member 100 and the base end portion 52A of the agitator sheet 52. In other words, the seal member 100 and the agitator 52 may be arranged on sides of the shaft 51 opposite to each other.

The seal member 100 is, when the developing device 1 is in a new and unused condition, in such an arrangement that a free end portion 102 thereof is attached to a peripheral area around an opening 10C formed in the second side wall 66B by, for example, welding or adhesion to seal the opening 10C.

Figure 2:
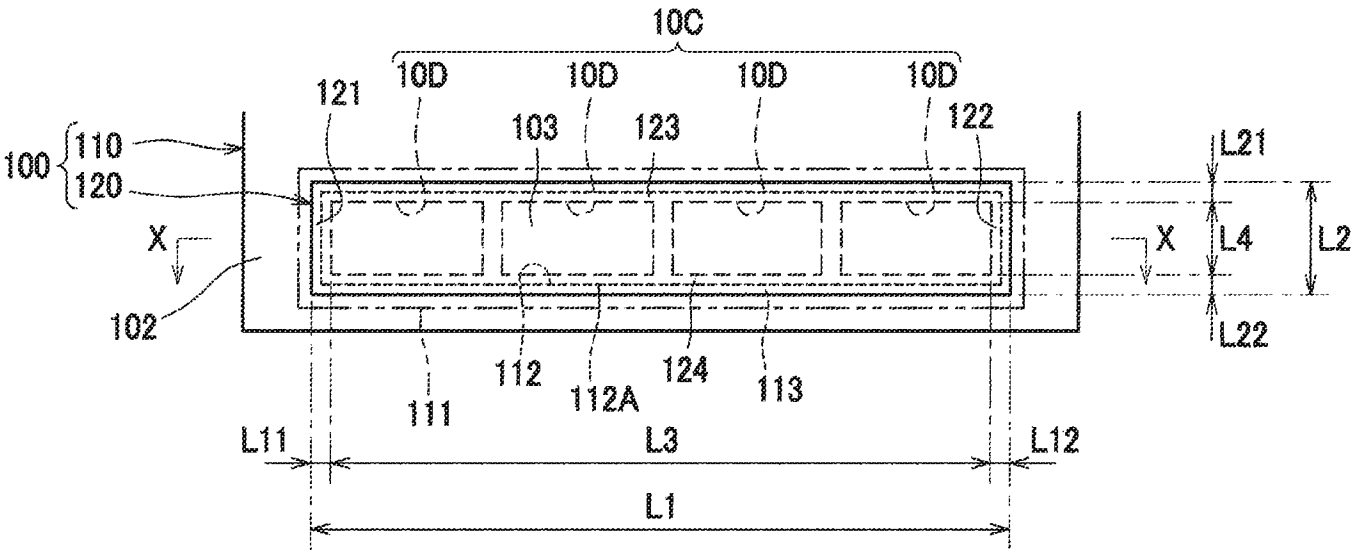
FIG. 2 is an illustrative view of a seal member in the developing device according to the embodiment of the present disclosure viewed along a direction A shown in FIG. 1.

The seal member 100 includes, as shown in FIG. 2, a ventilation section 103, at an area that seals the opening 10C formed in the second wall 66B (see also FIG. 1). The ventilation section 103 includes a ventilation member 120, which allows the air to pass but restrict the toner from passing there-through.

As shown in FIGS. 2 and 3, the seal member 100 includes a base member 110 and the ventilation member 120 that forms the ventilation section 103.

The base member 110 is a sheet, which is impermeable to the toner and to the air. The base member 110 may be made of, for example, polyvinyl chloride (PVC), polyethylene (PE), polystyrene (PS), or polyethylene terephthalate (PET). The base member 110 may be made to be thinner than the agitator sheet 52. The base member 110 is fixed to the shaft 51 at the base end portion 101 (see also FIG. 1) and attached to the peripheral area around the opening 10C in the second wall 66B at the free end portion 102. The base member 110 includes an attachable section 111, a through hole 112, and a ventilator attachment section 113, at the free end portion 102.

The attachable section 111 is an area, at which the base member 110 is attached to the peripheral area around the opening 10C in the second wall 66B. The attachable section 111 may be in a shape of a rectangular frame, which is larger than the opening 10C in a length and a width, so that the attachable section 111 may enclose the opening 10C when the attachable section 111 is attached to the second wall 66B.

The through hole 112 is formed within the attachable section 111 at a position to substantially coincide with the opening 10C. Specifically, the through hole 112 is formed at a position to be continuous with the opening 10C when the free end portion 102 is attached to the second wall 66B. The through hole 112 is formed to be larger than the opening 10C in a length and a width.

The ventilator attachment section 113 in the base member 110 is an area ranging between an edge 112A of the through hole 112 and the attachable section 111.

The ventilation member 120 forms the ventilation section 103 and is permeable to the air but is not permeable to the toner.

For example, the ventilation member 120 may be a sheet made of metal or resin having a plurality of ventilating holes 125, which may allow the air to pass flowing there-through but restrict the toner from passing (see also a first ventilation member 120A in FIG. 10A) there-through. Each of the ventilating holes 125 is formed in a size to allow air molecules to pass there-through but restrict particles of the toner from passing there-through. The size of each ventilating hole 125 may be, for example, between 4 and 8 μm at a diameter basis, if the ventilating hole 125 is in a circular shape.

For another example, the ventilation member 120 may be a sheet of fabric, which is substantially coarse to allow air molecules to pass there-through but is substantially dense to restrict particles of the toner from passing there-through.

For example, the ventilation member 120 may include unwoven chemical-fiber-based cloth and a metal filter such as an aluminum foil filter. Specifically, EFA-24NH (pressure drop 0.10 mmAq, 8μ collection efficiency 56%) or TTF-25 (pressure drop 0.05 mmAq, 8μ collection efficiency 74%), manufactured by TOYOBO Co., Ltd. may be employed.

As shown in FIG. 2, the ventilation member 120 is arranged within the attachable section 111, more specifically, within the attachable section 111 in a view along a direction orthogonal to the ventilation member 120, with end portions 121-124 being attached to the ventilator attachable section 113 in the base member 110 by, for example, welding or adhesion.

Figure 4:
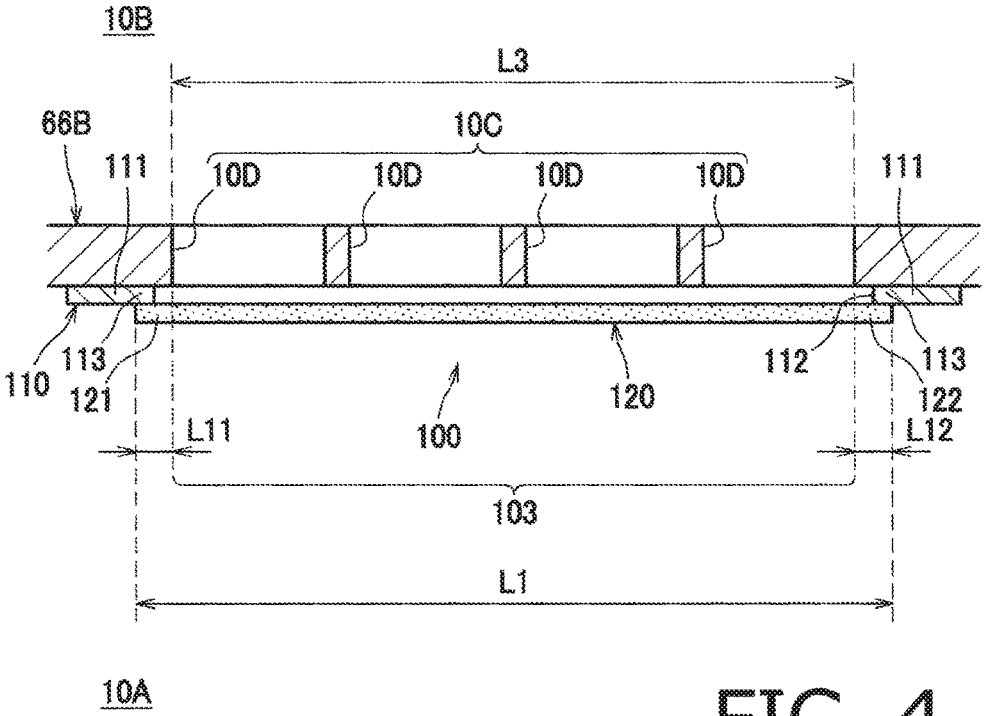
FIG. 4 illustrates a cross-sectional view of the seal member according to the embodiment of the present disclosure viewed at a line X-X shown in FIG. 2.

While the base member 110 is in a condition being attached to the peripheral area around the opening 10C in the second wall 66B, as shown in FIG. 4, the ventilation member 120 is arranged alongside the base member 100 in such an arrangement that end portions 121-124 thereof are on a side opposite to the second wall 66B across the base member 100 (in FIG. 4, merely the end portions 121, 122 are shown). In other words, the base member 100 is interposed between the ventilation member 120 and the second wall 66B. In this arrangement, therefore, the ventilation member 120 is in an inner position in the container chamber 10A with respect to the base member 110.

As shown in FIG. 4, a dimension L1 of the ventilation member 120 along the axial direction is greater than a dimension L3 of the opening 10 along the axial direction. In this regard, the end portions 121, 122 of the ventilation member 120 with regard to the axial direction are arranged to overlap the peripheral area around the opening 10C in the second wall 66B within a range of a first predetermined length(s) L11, L12. The first predetermined length(s) L11, L12 may be between 0.5 mm and 4 mm; preferably between 1 mm and 3.5 mm; and even more preferably between 1.5 mm and 3 mm. Meanwhile, the first predetermined length(s) L11, L12 may or may not necessarily be a same length.

Meanwhile, as shown in FIG. 2, a dimension L2 of the ventilation member 120 along the widthwise direction of the opening 10C is greater than a dimension L4 of the opening 10C along the widthwise direction. In this regard, the end portions 123, 124 of the ventilation member 120 with regard to the widthwise direction of the opening 10C are arranged to overlap the peripheral area around the opening 10C in the second wall 66B within a range of a second predetermine length(s) L21, L22. The second predetermined length(s) L21, L22 may be between 0.5 mm and 4 mm; preferably between 1 mm and 3.5 mm; and even more preferably between 1.5 mm and 3 mm. Meanwhile, the second predetermined length(s) L21, L22 may or may not necessarily be a same length.

As shown in FIG. 4, a part of the ventilation member 120 that coincides with the opening 10C along a direction orthogonal to the axial direction forms the ventilation section 103. Optimum pressure drop for the air passing through the ventilation section 103 may be, for example, between 0.098 Pa and 98 Pa (between 0.01 mmAq and 10 mmAq); preferably between 0.294 Pa and 49 Pa (0.03 mmAq and 5 mmAq); and even more preferably between 0.49 Pa and 9.8 Pa (0.05 mmAq and 1 mmAq).

Pressure drop refers to a difference between air pressures on an incoming side and an exit side of the ventilation member 120 as the air is filtrated through the ventilation member 120. Pressure drop may be measured by, for example, a manometer, including a U-tube manometer and an inclined-tube manometer.

Figure 5A:
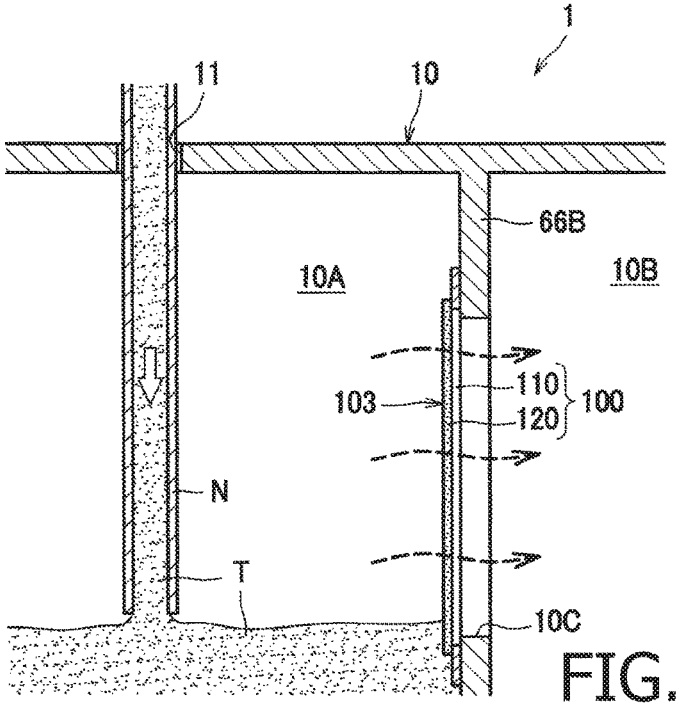
FIGS. 5A-5C illustrate a procedure to load a developing agent into a container chamber in the developing device according to the embodiment of the present disclosure.

In order to load the developing device 1 configured as above with a toner T, as shown in FIG. 5A, a nozzle N of a toner loading device (not shown) may be inserted into the container chamber 10A through a toner loading port 11, which is formed in the casing 10. Thus, the toner T may be delivered through the nozzle N to the container chamber 10A.

Figure 5B:
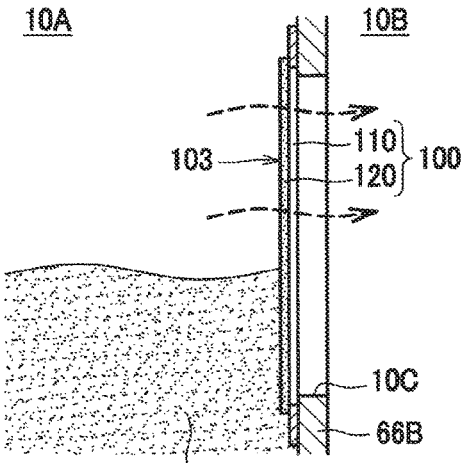
Figure 5C:
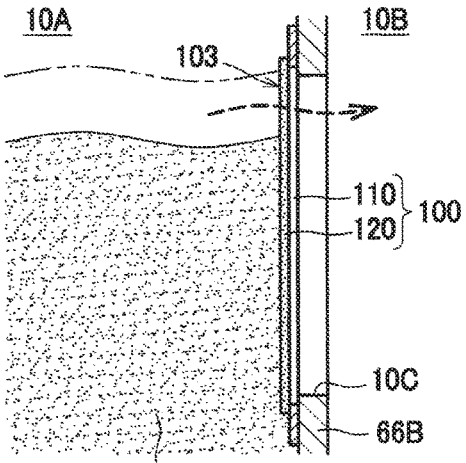

As the toner T flows into the container chamber 10A, as shown in FIGS. 5A-5C, a volume of the toner T in the container chamber 10A increases, and the air pressure inside the container chamber 10A may increase. However, the air inside the container chamber 10A may flow outward and exit the container chamber 10A through the ventilation section 103, as illustrated in broken arrows. Therefore, while the air pressure may increase to some extent in the container chamber 10A, the toner T flowing through the nozzle N should not be affected by the air pressure or prevented from flowing into the container chamber 10A. Thus, the toner T may be delivered to the container chamber 10A smoothly.

Starting from the unused condition shown in FIG. 1, as the shaft 51 is driven by the driving force to rotate counter-clockwise in FIG. 2, the agitator sheet 52 and the seal member 100 rotate along with the shaft 51. As the seal member 100 rotates along with the shaft 51 and the agitator sheet 52, the free end portion 102 of the seal member 100 is removed from the second wall 66B, and the opening 10C is unsealed. Thereafter, the toner in the container chamber 10A is stirred by the agitator sheet 52, which rotates along with the shaft 51, to be conveyed toward the opening 10C and delivered to the developing chamber 10B through the opening 10C.

According to the embodiment described above, the opening 10C is sealed by the seal member 100 when the developing device 1 is in the unused condition; therefore, leakage of the toner through the opening 10C may be prevented. Meanwhile, in order to load the container chamber 10A with the toner, the air may flow outward from the container chamber 10A through the ventilation section 103 in the seal member 100; therefore, the toner may be loaded in the container chamber 10A smoothly. Thus, a loading efficiency of the toner may be improved.

According to the embodiment described above, further, the seal member 100 may rotate along with the shaft 51; therefore, for initial use of the developing device 1, the seal member 100 may be removed from the second wall 66B as the shaft 51 rotates. Thus, a manual setup procedure to remove the seal member 100 may be eliminated.

According to the embodiment described above, further, the ventilation member 120 is arranged inside the attachable section 111; therefore, a size of the ventilation member 120 may be reduced compared to a size of a ventilation member 120 that is larger than or equal to the attachable section 111. Accordingly, for example, manufacturing cost for the seal member 100 may be reduced. Further, the ventilation member 120 is arranged not to overlap the attachable section 111 of the base member 110; therefore, the seal member 100 may be attached to the second wall 66B at the base member 110 alone by, for example, welding or an adhesive agent. In this regard, compared to a hypothetical configuration, in which the seal member is attached to the second wall 66B at the base member that overlaps the ventilation member, the seal member 100 may be attached to the second wall 66B more preferably.

According to the embodiment described above, further, the ventilation member 120 is in the arrangement such that the base member 100 is interposed between the ventilation member 120 and the second wall 66B and is attached to the ventilator attachment section 113 of the interposed base member 110. Therefore, while the base member 110 may be closely fitted to the second wall 66B, the size of the through hole 112 in the base member 100 may be enlarged to be larger than the size of the opening 10C. Accordingly, the base member 110 may be stably attached to the second wall 66B and may be prevented from being displaced or deformed (e.g., creased). Further, the size of the ventilation section 103, in a view along the direction orthogonal to the ventilation member 120, may be enlarged to be substantially as large as the size of the opening 10C formed in the second wall 66B. Therefore, the ventilation section 103 may provide maximum ventilation efficiency with regard to the size of the opening 10C.

Next, a second embodiment of the present disclosure will be described below. In the following description, items or structures which are the same as or similar to the items or the structure described in the previous embodiment will be referred to by the same reference signs, and description of those will be omitted.

Figure 6:
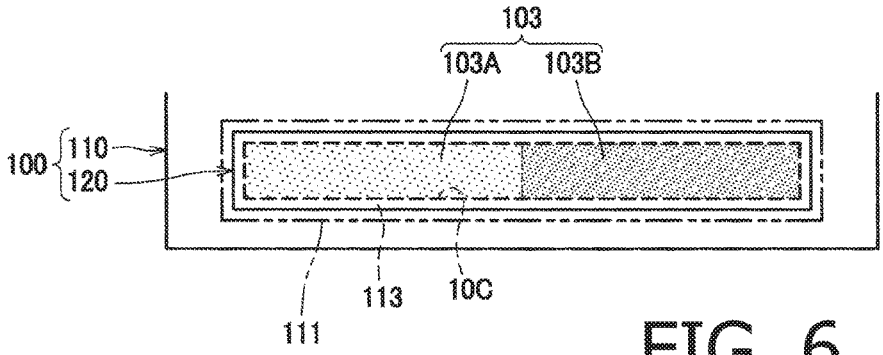
FIG. 6 is an illustrative view of the seal member in the developing device according to a second embodiment of the present disclosure viewed along the direction A shown in FIG. 1.

As shown in FIG. 6, the ventilation section 103 includes a first ventilation section 103A and a second ventilation section 103B arranged on a side of the first ventilation section 103A along the lengthwise direction of the opening 10. The first ventilation section 103A and the second ventilation section 103B provide different ventilation efficiencies. Exemplary configurations with the first ventilation section 103A and the second ventilation section 103B with different ventilation efficiencies will be described below.

Figure 7:
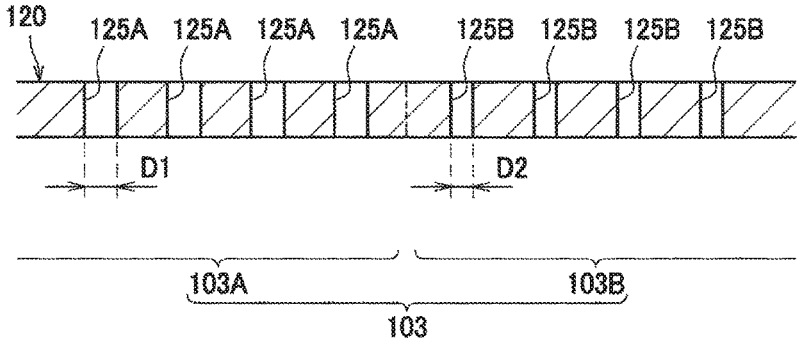
FIG. 7 is an enlarged cross-sectional view of the ventilation member with a first ventilation section and a second ventilation section in a first modified example of the second embodiment of the present disclosure.

For example, as shown in FIG. 7, the first ventilation section 103A and the second ventilation section 103B may have ventilating holes 125A and ventilating holes 125B, respectively, which allow the air to flow there-through but restrict the toner from passing there-through. A size of a diameter D1 of each ventilating hole 125A in the first ventilation section 103A may be larger than a size of a diameter of each ventilating hole 125B in the second ventilation section 103B. Thereby, the first ventilation section 103A and the second ventilation section 103B may provide different ventilation efficiencies.

Figure 8:
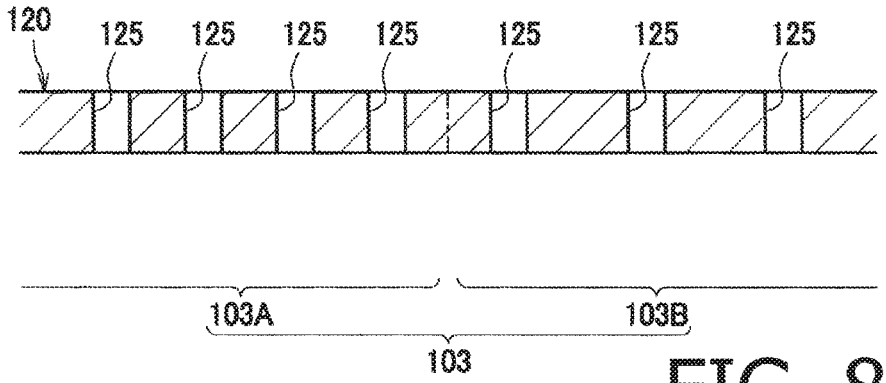
FIG. 8 is an enlarged cross-sectional view of the ventilation member with the first ventilation section and the second ventilation section in a second modified example of the second embodiment of the present disclosure.

For another example, as shown in FIG. 8, the first ventilation section 103A and the second ventilation section 103B may each have ventilating holes 125. Meanwhile, a quantity of the ventilating holes 125 per unit area in the first ventilation section 103A may be greater than a quantity of the ventilating holes 125 per unit area in the second ventilation section 103B. For example, as shown in FIG. 8, the quantity of the ventilating holes 125 per unit area in the first ventilation section 103A may be four (4) while the quantity of the ventilating holes 125 per unit area in the second ventilation section 103B may be three (3). Thus, the first ventilation section 103A and the second ventilation section 103B may provide different ventilation efficiencies.

Figure 9:
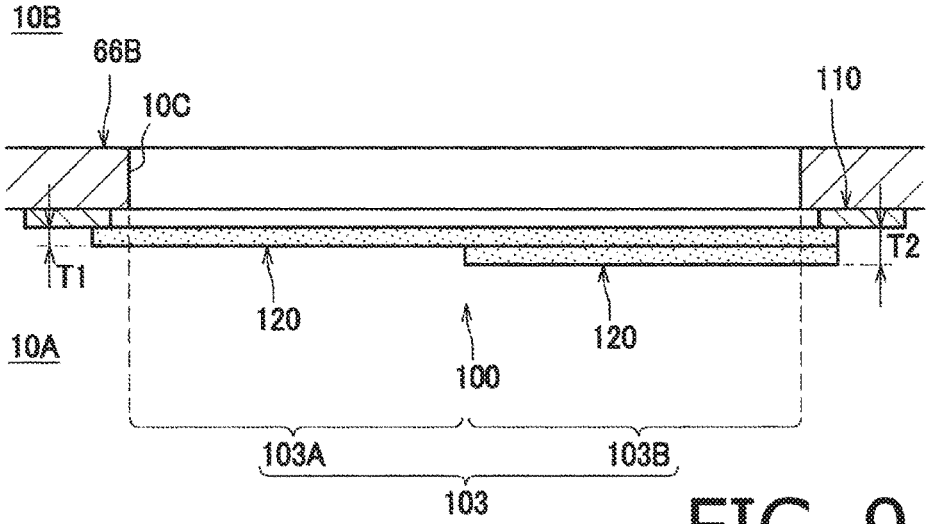
FIG. 9 is an enlarged cross-sectional view of the ventilation member with the first ventilation section and the second ventilation section in a third modified example of the second embodiment of the present disclosure.

For another example, as shown in FIG. 9, the first ventilation section 103A may be formed to have a thickness T1, which is smaller than a thickness T2 of the second ventilation section 103B. With the different thicknesses T1, T2, the first ventilation section 103A and the second ventilation section 103B may provide different ventilation efficiencies. More specifically, as shown in FIG. 9, the ventilation member 120 may be doubled to form two (2) layers in the second ventilation section 103B, while the ventilation member 120 in the first ventilation section 103A may be in a single layer. Thus, the thickness T1 may be smaller than the thickness T2. For another example, the first ventilation section 103A may have a single ventilation member 120 with a greater thickness while the second ventilation section 103B may have a single ventilation member 120 with a smaller thickness.

According to the exemplary configurations of the ventilation section 103, which has the first ventilation section 103A with the higher ventilation efficiency and the second ventilation section 103B with the lower ventilation efficiency, the ventilation section 103 may provide varied ventilation efficiencies at different positions along the lengthwise direction of the opening 10C. In this regard, the toner flowing in the container chamber 10A may accumulate to be higher from a bottom of the container chamber 10A. Therefore, based on an attitude of the casing 10 when the toner is being loaded in the container chamber 10A, the first ventilation section 103A may be located at an upper position while the second ventilation section 103B may be located at a lower position so that the first ventilation section 103A with the higher ventilation efficiency may serve more preferably to discharge the air from the container chamber 10A.

For another example of the ventilation section 103 having the first ventilation section 103A with the higher ventilation efficiency and the second ventilation section 103B with the lower ventilation efficiency, as shown in FIG. 10A, the first ventilation section 103A and the second ventilation section 103B may be made in different materials. More specifically, as shown in FIG. 10A, the first ventilation section 103A may include a first ventilation member 120A, and the second ventilation section 103B may include a second ventilation member 120B. The first ventilation member 120A may be a sheet of metal or resin having the ventilating holes 125. The second ventilation member 120B may be a sheet of an unwoven fiber cloth with air permeability.

For another example, as shown in FIG. 10B, a coating layer 130, which may change the ventilation efficiency in the second ventilation section 103B, may be formed in the second ventilation section 103B while no such coating layer may be formed in the first ventilation section 103A. Thus, the ventilation efficiency may be varied in different positions along the lengthwise direction of the opening 10C. The coating layer 130 may be, for example, a sheet of metal or resin having the ventilating holes 125 adhered to the second ventilation section 103B in the ventilation member 120. Thus, the ventilation efficiency in the first ventilation section 103A may be increased relatively to the ventilation efficiency in the second ventilation section 103B. In this regard, a structure or a material for the coating layer may not necessarily be limited to those mentioned above as long as the ventilation efficiencies are varied between the first ventilation section 103A and the second ventilation section 103B.

For another example, as shown in FIG. 11A, a dimension L5 of the first ventilation section 103A along the widthwise direction of the opening 10C may be greater than a dimension L6 of the second ventilator 103B along the widthwise direction of the opening 10C. Thus, the ventilation efficiencies may be varied between the first ventilation section 103A and the second ventilation section 103B. Meanwhile, a dimension of the first ventilation section 103A along the lengthwise direction of the opening 10C may be equal to a dimension of the second ventilation section 103B along the lengthwise direction of the opening 10C. Therefore, an area dimension of the first ventilation section 103A may be larger than an area dimension of the second ventilation section 103B, and the ventilation efficiency in the first ventilation section 103A may be higher than the ventilation efficiency in the second ventilation section 103B.

Meanwhile, the ventilation section 103 may include three (3) or more ventilation sections, of which ventilation efficiencies vary from one another. For example, as shown in FIG. 11B, the ventilation section 103 may include a first ventilation section 103A, a second ventilation section 103B, and a third ventilation section 103C. The second ventilation section 103B may be located on one side of the first ventilation section 103A along the lengthwise direction of the opening 10C, and the third ventilation section 103C may be located on one side of the second ventilation section 103B along the lengthwise direction of the opening 10C.

More specifically, the first ventilation section 103A may have a dimension along the widthwise direction of the opening 10C being greater than a dimension of the second ventilation section 103B along the widthwise direction of the opening 10C, and the dimension of the second ventilation section 103B along the widthwise direction of the opening 10C may be greater than a dimension of the third ventilation section 103C along the widthwise direction of the opening 10C. Therefore, the ventilation efficiencies may be higher in the second ventilation section 103B than the third ventilation section 103C and may be higher in the first ventilation section 103A than the second ventilation section 103B.

For another example, as shown in FIG. 11C, the ventilation section 103 may be formed to have a shape of, for example, trapezoid, of which dimension in the widthwise direction of the opening 10C declines to be smaller from one side toward the other side along the lengthwise direction of the opening 10C.

Although examples of carrying out the invention have been described, those skilled in the art will appreciate that there are numerous variations and permutations of the developing device that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

For example, the ventilation section 103 may not necessarily be arranged in the range on the seal member 100 to entirely overlap the opening 10C (see FIG. 2) but may be arranged in a range on the seal member 100 to partly overlap the opening 10C. In other words, the size of the ventilation section 103 may not necessarily be equal to the size of the opening 10C but may be smaller than the opening 10C.

For another example, as shown in FIG. 12, the ventilation section 103 may be arranged solely on one end portion in the area in the seal member 100 that seals the opening 10C with regard to the lengthwise direction of the opening 10C. In this arrangement, an area to ventilate by the ventilation section 103 may be reduced to be smaller or minimized to be the smallest. In this regard, manufacturing cost for the ventilation member 120 may be effectively reduced.

For another example, the ventilation member 120 may not necessarily be arranged on the opposite side to the second wall 66B across the base member 110, i.e., on the inner side in the container chamber 10 with respect to the bae member 110. The ventilation member 120 may be, for example, as shown in FIG. 13, arranged on an opposite side of the base member 110 to the container chamber 10A, i.e., on the outer side of the base member 110 facing toward the developing chamber 10B.

More specifically, as shown in FIG. 13, the ventilation member 120 may be arranged in the opening 10C. In other words, the ventilation member 120 may have a dimension L7 along the lengthwise direction of the opening 10C being smaller than the dimension L3 of the opening 10C along the lengthwise direction. Further, the ventilation member 120 may have a dimension along the widthwise direction of the opening 10C being smaller than the dimension L4 of the opening 10C along the widthwise direction. Therefore, the size of the ventilation member 120 may be reduced, and manufacturing cost for the seal member 100 may be effectively reduced.

Further, a through hole 212 in the base member 110 may be formed in a smaller size than the opening 10C, and the ventilation member 120 may be attached to a ventilator attachable section 213 in the base member 110, i.e., in an area between the edge of the through hole 212 and the attachable section 111. Therefore, in this example shown in FIG. 13, the ventilation section 103 may be formed at a position to coincide with the opening 10C and with the through hole 212 along a direction orthogonal to the axial direction. In this regard, the ventilation section 103 may be formed in a size substantially equal to the through hole 212, which is smaller than the opening 10C.

For another example, the ventilation member 120 may not necessarily be formed in the size to fall within the attachable section 111 in the base member 120 but may be formed to be larger than or equal to the size of the attachable section 111 of the base member 110.

For another example, the seal member 100 may not necessarily include the base member 110 and the ventilation member 120 but may include solely one of the base member and the ventilation member. More specifically, the seal member may be made of a member that serves similarly to the ventilation member. In other words, the seal member may be a sheet, which is permeable to the air. For another example, the seal member may be a sheet with no permeability, yet having ventilating holes, which allows the air to flow there-through but restricts the toner from passing there-through, at a position coincident with the opening of the casing.

For another example, the seal member 100 may not necessarily be provided separately from the agitator sheet 52 in the agitator 50 to be supported by the shaft 51, but the seal member 100 may be an agitator sheet. In other words, the agitator sheet in the agitator may be provided to serve as the seal member that includes the ventilation section at a position to at least partly coincide with the opening.

For another example, the seal member 100 may not necessarily be supported by the shaft 51 to rotate along with the shaft 51 in the agitator 50 but may be, for example, bonded to a wall of the casing to close an opening formed on the wall.

For another example, the toner may not necessarily be loaded in the container chamber 10A through the toner filling port 11. For example, a toner inlet port may be formed at one end of the shaft along the axial direction, and a toner outlet port may be formed on a side of the shaft, so that the toner may be supplied to the container chamber through the shaft.

Moreover, application of the present disclosure may not necessarily be limited to the developing device 1 having the developing roller 20, but the present disclosure may be applied to, for example, a developing device (e.g., a process cartridge) with a photosensitive member additionally to the developing roller 20 and the supplying roller 30 (see FIG. 1).

What is claimed is:

1. A developing device, comprising:

a casing, the casing comprising:

a divider wall dividing a space inside the casing into a container chamber and a developing chamber, the divider wall comprising an opening, the container chamber accommodating a developing agent; and a developing roller; and a seal member configured to seal the opening, wherein the seal member comprises:

a base member having a through hole, the base member comprising an attachable section removably attached to a peripheral area around the opening in the divider wall; and a ventilation member forming a ventilation section, the ventilation member being arranged within the attachable section, the ventilation section configured to allow air to pass there-through but restrict the developing agent from passing there-through at least at a part of an area that seals the opening, wherein a dimension of the ventilation member along a lengthwise direction of the opening is greater than a dimension of the opening along the lengthwise direction, wherein the ventilation member is arranged alongside the base member in an arrangement where the base member is interposed between the ventilation member and the divider wall, and wherein the ventilation member is attached to an area ranging between an edge of the through hole and the attachable section in the base member.

2. The developing device according to claim 1, further comprising:

a shaft supported rotatably by the casing, wherein the seal member is arranged inside the container chamber and is supported by the shaft at a base end portion thereof to rotate along with the shaft.

3. The developing device according to claim 1, wherein the ventilation member is arranged in the opening.

4. The developing device according to claim 1, wherein the ventilation member is arranged to overlap the peripheral area around the opening in the divider wall at an end portion thereof with regard to the lengthwise direction within a range between 0.5 mm and 4 mm along the lengthwise direction.

5. The developing device according to claim 1, wherein the ventilation member is arranged to overlap the peripheral area around the opening in the divider wall at an end portion thereof within a range between 1 mm and 3.5 mm with regard to the lengthwise direction.

6. The developing device according to claim 1, wherein the ventilation member is arranged to overlap the peripheral area around the opening in the divider wall at an end portion thereof within a range between 1.5 mm and 3 mm with regard to the lengthwise direction.

7. The developing device according to claim 1, wherein the ventilation section comprises a first ventilation section and a second ventilation section, the second ventilation section being arranged on a side of the first ventilation section along a lengthwise direction of the opening;

wherein each of the first ventilation section and the second ventilation section comprises ventilation holes that allow the air to pass there-through but restrict the developing agent from passing there-through; and wherein a size of each ventilation hole in the first ventilation section is greater than a size of each ventilation hole in the second ventilation section.

8. The developing device according to claim 1, wherein the ventilation section comprises a first ventilation section and a second ventilation section, the second ventilation section being arranged on a side of the first ventilation section along a lengthwise direction of the opening;

wherein each of the first ventilation section and the second ventilation section comprises ventilation holes that allow the air to pass there-through but restrict the developing agent from passing there-through; and wherein a quantity of the ventilation holes per unit area in the first ventilation section is greater than a quantity of the ventilation holes per unit area in the second ventilation section.

9. The developing device according to claim 1, wherein the ventilation section comprises a first ventilation section and a second ventilation section, the second ventilation section being arranged on a side of the first ventilation section along a lengthwise direction of the opening, and wherein a dimension of the first ventilation section along a widthwise direction of the opening is greater than a dimension of the second ventilation section along the widthwise direction.

10. The developing device according to claim 1, wherein the ventilation section comprises a first ventilation section and a second ventilation section, the second ventilation section being arranged on a side of the first ventilation section along a lengthwise direction of the opening; and wherein a thickness of the first ventilation section is smaller than a thickness of the second ventilation section.

11. The developing device according to claim 1, wherein the ventilation section comprises a first ventilation section and a second ventilation section, the second ventilation section being arranged on a side of the first ventilation section along a lengthwise direction of the opening; and wherein the first ventilation section and the second ventilation section have different ventilation efficiencies.

12. The developing device according to claim 1, wherein the ventilation section is arranged on one end portion in the part of the area in the seal member that seals the opening with regard to a lengthwise direction of the opening.

13. The developing device according to claim 1, wherein a pressure drop caused by the ventilation section for the air passing there-through ranges between 0.098 Pa and 98 Pa.

14. A developing device, comprising:

a casing, the casing comprising:

a divider wall dividing a space inside the casing into a container chamber and a developing chamber, the divider wall comprising an opening, the container chamber accommodating a developing agent; and a developing roller; and an agitator placed inside the container chamber and assembled to the casing, the agitator comprising:

a shaft; and a sealer sheet fixed to the shaft and attached around the opening in the divider wall, wherein the sealer sheet comprises a ventilation member, the ventilation member comprising a first ventilation section and a second ventilation section, the second ventilation section being arranged on a side of the first ventilation section along a lengthwise direction of the opening, each of the first ventilation section and the second ventilation section comprising a plurality of ventilation holes, a size of each of the plurality of ventilation holes being between 4 and 8 μm at a diameter basis, and wherein a size of each of the plurality of ventilation holes in the first ventilation section is greater than a size of each of the plurality of ventilation holes in the second ventilation section.

15. The developing device according to claim 14, wherein the sealer sheet further comprises:

a base member comprising a through hole, the through hole overlapping the opening, and wherein the ventilation member is arranged around the through hole in the base member.

16. The developing device according to claim 14, wherein the agitator further comprises an agitator sheet fixed to the shaft.

17. A developing device, comprising:

a casing, the casing comprising:

a divider wall dividing a space inside the casing into a container chamber and a developing chamber, the divider wall comprising an opening, the container chamber accommodating a developing agent; and a developing roller; and a seal member configured to seal the opening, wherein the seal member comprises a ventilation section configured to allow air to pass there-through but restrict the developing agent from passing there-through at least at a part of an area that seals the opening, wherein the ventilation section comprises a first ventilation section and a second ventilation section, the second ventilation section being arranged on a side of the first ventilation section along a lengthwise direction of the opening, wherein each of the first ventilation section and the second ventilation section comprises ventilation holes that allow the air to pass there-through but restrict the developing agent from passing there-through, and wherein a size of each ventilation hole in the first ventilation section is greater than a size of each ventilation hole in the second ventilation section.

18. A developing device, comprising:

a casing, the casing comprising:

a divider wall dividing a space inside the casing into a container chamber and a developing chamber, the divider wall comprising an opening, the container chamber accommodating a developing agent; and a developing roller; and a seal member configured to seal the opening, wherein the seal member comprises a ventilation section configured to allow air to pass there-through but restrict the developing agent from passing there-through at least at a part of an area that seals the opening, wherein the ventilation section comprises a first ventilation section and a second ventilation section, the second ventilation section being arranged on a side of the first ventilation section along a lengthwise direction of the opening, wherein each of the first ventilation section and the second ventilation section comprises ventilation holes that allow the air to pass there-through but restrict the developing agent from passing there-through, and wherein a quantity of the ventilation holes per unit area in the first ventilation section is greater than a quantity of the ventilation holes per unit area in the second ventilation section.

19. A developing device, comprising:

a casing, the casing comprising:

a divider wall dividing a space inside the casing into a container chamber and a developing chamber, the divider wall comprising an opening, the container chamber accommodating a developing agent; and a developing roller; and a seal member configured to seal the opening, wherein the seal member comprises a ventilation section configured to allow air to pass there-through but restrict the developing agent from passing there-through at least at a part of an area that seals the opening, wherein the ventilation section comprises a first ventilation section and a second ventilation section, the second ventilation section being arranged on a side of the first ventilation section along a lengthwise direction of the opening, and wherein a dimension of the first ventilation section along a widthwise direction of the opening is greater than a dimension of the second ventilation section along the widthwise direction.

20. A developing device, comprising:

a casing, the casing comprising:

a divider wall dividing a space inside the casing into a container chamber and a developing chamber, the divider wall comprising an opening, the container chamber accommodating a developing agent; and a developing roller; and a seal member configured to seal the opening, wherein the seal member comprises a ventilation section configured to allow air to pass there-through but restrict the developing agent from passing there-through at least at a part of an area that seals the opening, wherein the ventilation section comprises a first ventilation section and a second ventilation section, the second ventilation section being arranged on a side of the first ventilation section along a lengthwise direction of the opening, and wherein a thickness of the first ventilation section is smaller than a thickness of the second ventilation section.

21. A developing device, comprising:

a casing, the casing comprising:

a divider wall dividing a space inside the casing into a container chamber and a developing chamber, the divider wall comprising an opening, the container chamber accommodating a developing agent; and a developing roller; and a seal member configured to seal the opening, wherein the seal member comprises a ventilation section configured to allow air to pass there-through but restrict the developing agent from passing there-through at least at a part of an area that seals the opening, wherein the ventilation section comprises a first ventilation section and a second ventilation section, the second ventilation section being arranged on a side of the first ventilation section along a lengthwise direction of the opening, and wherein the first ventilation section and the second ventilation section have different ventilation efficiencies.

* * * * *